United States Patent [19]

Fabian et al.

[11] Patent Number: 4,855,032

[45] Date of Patent: Aug. 8, 1989

[54] ELECTRODE STRUCTURE

[75] Inventors: Peter Fabian; Helmut Krebs, both of Freigericht; Heinrich Simon, Langenselbold, all of Fed. Rep. of Germany

[73] Assignee: Heraeus Elektroden GmbH, Hanau, Fed. Rep. of Germany

[21] Appl. No.: 223,168

[22] Filed: Jul. 22, 1988

[30] Foreign Application Priority Data

Aug. 11, 1987 [DE] Fed. Rep. of Germany ..... 3726674

[51] Int. Cl.[4] ..... C25B 11/02; C25B 9/04

[52] U.S. Cl. ..... 204/286; 204/288; 204/289

[58] Field of Search ..... 204/286–289, 204/279, 283

[56] References Cited

U.S. PATENT DOCUMENTS

| | | | |
|---|---|---|---|
| 4,149,956 | 4/1979 | Bess, Sr. et al. | 204/284 |
| 4,343,689 | 8/1982 | de Nora et al. | 204/286 X |
| 4,425,214 | 1/1984 | Pellegri | 204/286 X |
| 4,502,935 | 3/1985 | Lohrberg et al. | 204/288 X |
| 4,617,101 | 10/1986 | Sato et al. | 204/283 X |
| 4,738,763 | 4/1988 | Abrahamson et al. | 204/279 X |

FOREIGN PATENT DOCUMENTS

| | | |
|---|---|---|
| 0055930 | 8/1985 | European Pat. Off. . |
| 3519272 | 12/1986 | Fed. Rep. of Germany . |
| 3625506 | 2/1987 | Fed. Rep. of Germany . |
| 2180556 | 4/1987 | United Kingdom . |

*Primary Examiner*—Donald R. Valentine
*Attorney, Agent, or Firm*—Felfe & Lynch

[57] ABSTRACT

An electrode structure for membrane electrolysis cells comprises a planar electrode part which is joined by metal spacers to a sheet metal support serving as current distributor. The spacers are made in the form of a spring clip mounting comprising a spring part and a springless part, the spring part being fixedly joined to the support while the springless part is integral with the electrode part. In case of the need to reactivate or repair the active electrode parts the spring clip mounting permits them to be separated easily from their supports and then they can be sent away directly for reactivation or repair.

8 Claims, 2 Drawing Sheets

ELECTRODE STRUCTURE

Figure 1A:
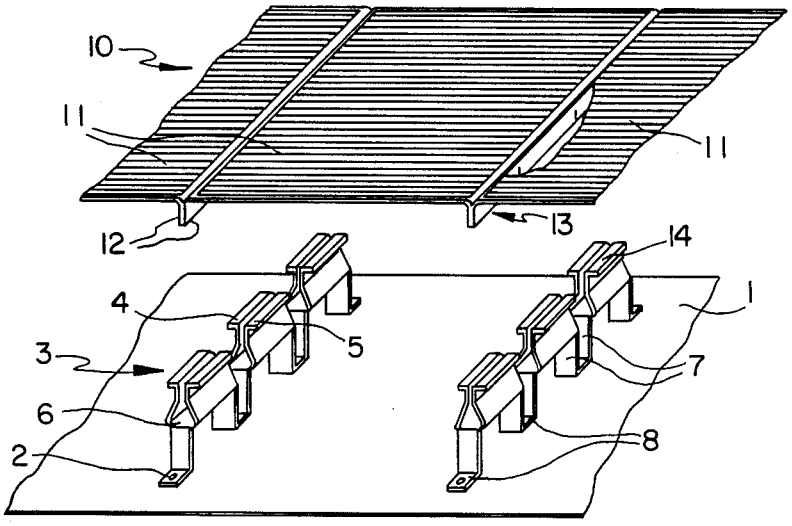

The invention relates to an electrode structure for an electrochemical membrane cell with a planar electrode structure disposed one on each side of a membrane, at least the anodic electrode structure being joined by metallic spacers to a support of sheet metal serving as a current distributor.

An electrolytic cell which operates by the membrane process is disclosed in EP-OS No. 55 930. It is referred to hereinafter also as a membrane cell. The actual electrode structure is further explained by way of example with the aid of DE-OS No. 36 25 506 in which a film-like membrane is described having electrodes on both sides. Furthermore, an electrode structure suitable for membrane cells is disclosed in DE-PS No. 35 19 272, and has a support of sheet metal serving as current distributor, on which a plurality of plate-like electrode parts form a laminated structure with a planar surface that is pressed directly against the membrane.

In the known electrode structures there is a problem involved in the fixed mechanical connection provided by metal spacers or bosses in the support between the sheet-metal support serving as current distributor and the plate-like active electrode parts, which have to be separated from one another in case of the reactivation or repair of the electrodes. This is accomplished, as a rule, by mechanical cutting methods, such as milling, drilling or grinding. After the reactivation the electrode surface is again permanently welded electrically and mechanically to the current distributor through spacers.

On account of the difficult mechanical operations connected with the reactivation or repair, the electrolysis apparatus is out of operation for a relatively long time, and high transport costs are incurred since all of the electrode structures have to be returned by the client to the manufacturer.

U.S. Pat. No. 4,149,956 discloses an anode structure for electrolysis cells with horizontally disposed electrodes, in which the active anode parts consisting of valve metal are connected by means of their current distributors to electrical feeders by releasable threaded means.

Connections of this kind cannot be applied to membrane cells.

The invention sets for itself the task of creating an electrode structure that can be used in membrane cells, which will have easily removable active electrode surfaces which can be disassembled from their supports without any particular mechanical difficulty, but which nevertheless permit good current transfer in the operating condition.

In accordance with the invention, an electrode structure for an electrochemical membrane cell with a planar electrode structure disposed on either side of a membrane, comprises a support of sheet metal serving as current distributor and at least an anodic electrode structure being joined thereto. The electrode structure also includes metal spacers through which said anodic structure is joined to said support. The metal spacers are made in the form of a spring clip mounting which comprises a spring portion and a substantially springless portion, the spring portion being fixedly joined to the support.

In a preferred embodiment at least one spring clip serves as a spacer and has a channel-like cross section with flanges which converge and then diverge again at their free ends, the ends of these flanges opening on the side facing away from the support; the clip is joined to the support in a mechanically tight and electrically conducting manner. In this clip there is engaged a ridge-like projection of the electrode plate, which is perpendicular to the plane of the plate. This ridge-like projection is formed by bending from the electrode plate.

The clips have at their extremities contact surfaces disposed parallel to the planar electrode surfaces. In the operation of an electrode system of this kind the electrode surface is fixed and contacted by the clip mounting. In addition, the electrode surface is pressed against the contact surfaces of the clip mounting by the pressure applied by the cell membrane. The support consists of sheet metal with a thickness in the range from 0.4 to 3 mm.

A special advantage is to be found in the possibility, when reactivating or when repairing electrode parts, of separating them from the support by simply pulling them out and replacing them with spare electrode parts from stock, so that the electrolysis apparatus does not have to be shut down for long periods because of the removal of electrode parts or of electrodes to be reactivated. Since only the active segments of electrodes need to be treated, the usual stocking and transport costs are reduced to a minimum.

For a better understanding of the invention, together with other and further objects thereof, reference is made to the following description, taken in connection with the accompanying drawings, and its scope will be pointed out in the appended claims.

Referring now to the drawings:

FIG. 1*a* shows the support and the electrode before they are assembled in the clip mounting.

FIG. 1 *b* is a fragmentary view of an assembled clip mounting with the electrode plate and support.

Figure 2B:
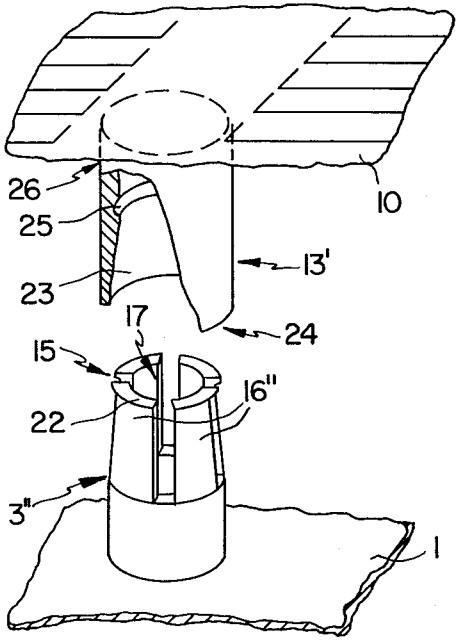
Figure 2A:
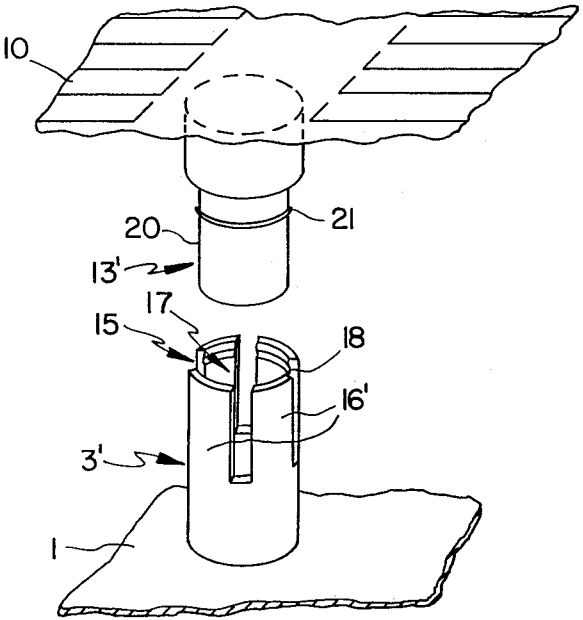

FIG. 2*a* shows a releasable spring clip mounting composed of a longitudinally slotted cylindrical sleeve having a taper in its interior for receiving a truncoconical end of a stud.

FIG. 2*b* shows, as an additional element, a sleeve which is also made with longitudinal slots and whose outer configuration is truncoconical and can be snapped onto a stud having a likewise truncoconical configuration.

According to FIG. 1*a* the clip mounting, preferably spot-welded at 2 to the support 1, preferably comprises a spring clip 3 of channel-like cross section and converging flanges 4 and 5, which diverge again at their free ends to terminate in contact surfaces 14; the contact surfaces 14 preferably run parallel to the plane of the support 1. As seen in FIG. 1*a*, two rows preferably are provided each with three such spring clips, the bottoms 6 between the flanges 4 and 5 of the clips preferably being mounted on perpendicularly disposed legs 7 and on feet 8 disposed parallel to the plane of the support 1. The feet 8 are preferably spot-welded at 2 to the support 1. The channel bottoms 6, legs 7 and feet 8 preferably constitute a continuous strip flaring outwardly at the flanges 4 and 5, the strip preferably being stamped from spring metal and bent to shape.

Above the support 1 is shown a portion of the electrode plate 10, which in the present case preferably comprises three sections 11 of which the two outer sections and the support 1 beneath them are cut away for greater clarity. At the edges of each section 11 the flanges 12 preferably are formed by bending at right angles and preferably are so disposed that the surface of the electrode plate 10 forms a continuous plane. The margins 12 in the form of a ridge-like projection are the springless part of the spring clip mounting.

Figure 1B:
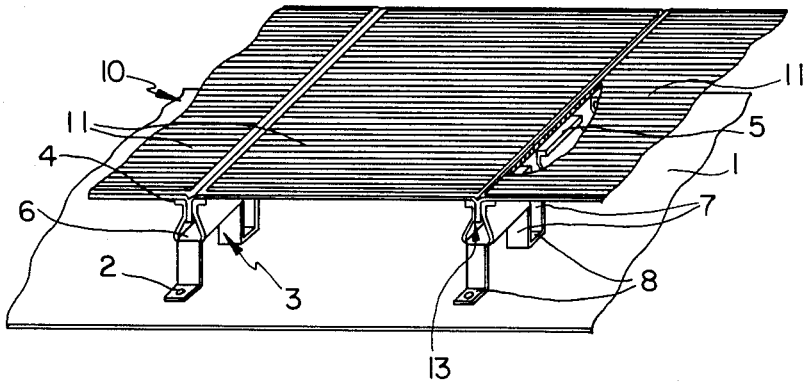

FIG. 1*b* is a cut-away view showing how the margins of the plate sections 11, when combined to form a single part 13, are introduced into the open end of the spring clips 3 and are held therein by spring pressure. In practice the springless part 13 of the electrode plate is inserted into the spring clip 3 until the faces 14 of the flanges 4 and 5 are brought into contact with the bottom of the electrode plate 11.

The electrode plate can comprise, for example, a plate slotted in a manner resembling a venetian blind. It is also possible, however, to provide other types of electrodes, such as wire electrodes, mesh electrodes, expanded metal electrodes or laminated electrodes. The support 1 forms in practice a kind of electrode tank which together with the support of the counterelectrode, which is made in the same manner, forms a closed chamber which is divided by the membrane into two electrolyte chambers, i.e., an anolyte chamber and a catholyte chamber. The two supports of each cell are separated electrically from one another by the membrane and by additional gaskets. The electrolyte chambers are provided with their own liquid inlet and outlet openings, the anolyte chamber being connected to the brine circuit, while water is fed to the catholyte chamber. Furthermore, means are provided for removing the chlorine and hydrogen gas from the anolyte and catholyte chambers, respectively. The materials on the cathode side preferably are steel and spring-tempered nickel alloys, respectively, while on the anode side titanium of good spring properties and titanium alloys preferably are used. The edges 12 of the plate sections 11 which serve as the springless part 13 of the spring system can have notches or gaps in order to achieve the best possible contact in the area of the spring clips in spite of manufacturing inaccuracies. The number of spring clips will depend substantially on the size of the electrode plates. In the case of small electrode plates it is possible to utilize only a single spring clip.

In FIG. 2*a* is shown an additional embodiment of the clip mounting, in which the part 3' that is joined to the support has a spring portion in the form of a sleeve which is provided with longitudinal slots 15 reaching all the way to its open end and is affixed to the support 1. The interior of the sleeve preferably tapers from its mouth 17, and an annular groove 18 preferably is provided near the mouth. The sleeve 3' is affixed mechanically and electrically conductively to the support 1 of which only a portion is shown.

The stud 13' has a truncoconical portion 20 which can mate with the tapered interior of the sleeve 3'. This springless stud 3' preferably is affixed at its larger end, in a mechanical and electrically conductive manner, to an electrode plate 10 of which only a portion is shown. In the transition between the truncoconical end 20 and the cylindrical part of the stud 13' preferably is a circumferential annular bead 21 which catches in the circumferential annular groove 18 when the end 20 is inserted into the sleeve. Thereafter, due to the interaction between the tapering portions of the stud 13' and the sleeve 3', the connection is extremely stable and can hardly be released by pulling them apart. The spring clip mounting represented in FIG. 2*a* can be used as a single spring mounting in the case, for example, of small electrode surfaces. It is, however, also possible to use a greater number of them as in the example explained in connection with FIG. 1*a* and 1*b*.

Another embodiment of the subject matter of the invention is explained with the aid of FIG. 2*b*. In this embodiment the part 3'' has as its spring a sleeve which preferably is provided on its exterior with a truncoconical taper towards its mouth 17, and is composed of segments 16''. The outer end of the mouth 17 is in the form of an annular flange 22 interrupted by the longitudinal slots 15. The spring part 3'' preferably is fastened in an electrically conductive and mechanical manner at its extremity opposite its mouth 17 to the support 1 which is represented only in part.

The springless part 13'' of the spring clip mounting is provided with a stud-like portion which can b placed over the circumferential segments 16''. This stud-like portion has on its interior 23 a truncoconical taper running inwardly from its mouth 24. In the transition between the taper of the interior 23 and a hollow cylinder in the springless part 13'' there preferably is a circumferential groove 25 in which the annular flange 22 can snap upon installation. For better clarity both the sleeve of the springless part 13'' and the electrode plate 10 are shown in a fragmentary manner.

In this arrangement, too, the fastening obtained when the annular flange 22 is snapped into the annular groove 25 proves to be extremely stable, while the interaction of the two surfaces of the tapers also intensifies the fastening pressure. The electrode structure, i.e., the form of the electrodes of FIGS. 2*a* and 2*b* can be the same as in FIGS. 1*a* and 1*b;* the same applies to the materials used. The disassembly prior to the reactivation of the active electrode parts can be accomplished by tools such as screwdrivers. The consequential costs involved in the long-term operation of membrane cells can be reduced considerably by the invention, since the removal and replacement of the active electrode surfaces can be performed easily, quickly, gently and inexpensively.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. An electrode structure for an electrochemical membrane cell with a planar eleotrode structure disposed on either side of a membrane, comprising:

a support of sheet metal serving as current distributor, at least one anodic electrode structure being joined thereto, metal spacer means through which said electrode structure is joined to said support, said metal spacer means being made in the form of a spring clip mounting which comprises a spring portion and a substantially springless portion, said spring portion being fixedly joined to said support, and said springless portion projecting in the form of a comb-like projection from said electrode structure.

2. An electrode structure according to claim 1, in which said spring portion comprises a spring clip of U-shaped cross section and having limbs having free end portions bent about to form contact surfaces.

3. An electrode structure according to claim 1, in which said electrode structure includes a planar electrode portion which is in the form of an electrode plate and said comb-like projection comprises at least one bent margin of said planar electrode portion which is pushed into said spring clip mounting until it engages said contact surfaces.

4. An electrode structure according to claim 3, in which said electrode plate comprises a plurality of plate sections having adjacent margins which form said comb-like projection which is introduced into said clip mounting.

5. An electrode structure for an electrochemical membrane cell with a planar electrode structure disposed on either side of a membrane, comprising:

a support of sheet metal serving as current distributor, at least one anodic electrode structure being joined thereto, metal spacer means through which said electrode structure is joined to said support, said metal spacer means being made in the form of a spring clip mounting which comprises a spring portion and a substantially springless portion, said spring portion being fixedly joined to said support, and said springless portion comprising a spring area in the form of a sleeve having longitudinal slots and situated on an end remote from said support.

6. An electrode structure in accordance with claim 5, in which said springless portion has a stud-like portion which engages into said sleeve.

7. An electrode structure for an electrochemical membrane cell with a planar electrode structure disposed on either side of a membrane, comprising:

a support of sheet metal serving as current distributor, at least one anodic electrode structure being joined thereto, metal spacer means through which said first electrode structure is joined to said support, said metal spacer means being made in the form of a spring clip mounting which comprises a spring portion and a substantially springless portion, said spring portion being fixedly joined to said support, and said springless portion projecting in the form of a comb-like projection from said first electrode structure.

8. An electrode structure for an electrochemical membrane cell with a planar electrode structure disposed on either side of a membrane, comprising:

a support of sheet metal serving as current distributor, at least one anodic electrode structure being joined thereto, metal spacer means through which said first electrode structure is joined to said support, said metal spacer means being made in the form of a spring clip mounting which comprises a spring portion and a substantially springless portion, said spring portion being fixedly joined to said support, and said spring portion comprising a spring area in the form of a sleeve having longitudinal slots and situated on an end from said support.

* * * * *

UNITED STATES PATENT AND TRADEMARK OFFICE

CERTIFICATE OF CORRECTION

PATENT NO. : 4,855,032

DATED : August 8, 1989

INVENTOR(S) : Peter Fabian, et al.

It is certified that error appears in the above-identified patent and that said Letters Patent is hereby corrected as shown below:

Column 3, line 55 for "stud 3'" read -- stud 13' --.

Column 4, line 15 for "can b" read -- can be --.

Column 5, line 18 for "at least one" read -- at least an --.

Column 6, line 6 for "at least one anodic" read -- at least a first --.

Column 6, line 21 for "at least one anodic" read -- at least a first --.

Signed and Sealed this

Twenty-fourth Day of April, 1990

*Attest:*

*Attesting Officer*

HARRY F. MANBECK, JR.

*Commissioner of Patents and Trademarks*